United States Patent [19]

Sutter

[11] 4,005,497

[45] Feb. 1, 1977

[54] SUPPORTING PLATE ARRANGEMENT

[75] Inventor: Erhard Sutter, Sursee, Switzerland

[73] Assignee: Hermann Lanz AG, Switzerland, Murgenthal, Switzerland

[22] Filed: June 27, 1975

[21] Appl. No.: 591,116

[30] Foreign Application Priority Data

July 12, 1974 Switzerland ..... 9632/74

[52] U.S. Cl. ..... 5/68; 5/74

[51] Int. Cl.[2] ..... H61G 7/06

[58] Field of Search ..... 5/64, 66–68, 5/73–76, 327 R, 327 B, 110; 297/31, 369

[56] References Cited

UNITED STATES PATENTS

| | | | |
|---|---|---|---|
| 770,395 | 9/1904 | Seng | 5/74 |
| 1,641,991 | 9/1927 | Ramsey | 5/75 |
| 3,538,522 | 10/1970 | Adams | 5/327 R |
| 3,688,319 | 9/1972 | Gulliver | 5/66 |

*Primary Examiner*—Casmir A. Nunberg
*Attorney, Agent, or Firm*—Werner W. Kleeman

[57] ABSTRACT

A supporting or support plate arrangement for adjusting the inclination of at least one part of a repose surface of reclining furniture or the like, comprising two levers forming an articulated lever pair, one of the levers being constituted by a substantially U-shaped rack member provided with teeth at the leg edges and secured to a part of the reclining furniture. A slide member or slide is displaceable upon the toothed rack member and in which there is guided the end of a support lever member hingedly mounted at the second articulated lever of the lever pair. The aforementioned end of the support lever member engages between the legs of the U-shaped rack member and such end is guided in the slide member in such a manner that it is movable between a work position where it is in engagement with the teeth of the rack member and a rest position which permits the free displacement and rocking of the levers towards one another. A spring is provided between both articulated levers and/or a counterweight is provided at the second articulated lever, which strive to spread apart the articulated levers from one another. The free end of the second articulated lever possesses a support or contact surface for the part of the repose surface of the furniture which is adjustable in its inclination.

21 Claims, 11 Drawing Figures

SUPPORTING PLATE ARRANGEMENT

BACKGROUND OF THE INVENTION

The present invention broadly relates to the furniture art and, more specifically, concerns a new and improved construction of supporting or support plate arrangement for adjusting the inclination of at least one part of the repose or lying surface of a piece of furniture upon which a person can recline or lie.

In the description to follow such piece of furniture will be sometimes conveniently referred to simply as reclining furniture.

As a general rule such support or supporting plate arrangements for adjusting the head end of reclining furniture are hingedly connected both at the frame as well as also at the reclining surface part or portion which is to be adjusted, typically a lower mattress. They are actuated in that the adjustable part is raised or lowered.

In principle such prior art supporting plate arrangement or support plate also can be used for the elevational adjustment of the foot end of the furniture, i.e., as a so-called foot elevational support. However, this results in the limitation that the pivotable lower mattress portion cannot be further raised than permitted by the maximum spreading apart of the support plate owing to the pivotal connection of the lower mattress portion with the support plate. Due to the open gap or space which is thus formed between the frame and the lower mattress access to a storage cabinet or compartment for the storage of the bed linen, sheets, blankets or the like —hereinafter conveniently referred to as the bedding—arranged below the lower mattress is hardly possible or at best with extreme difficulty. To overcome this drawback it has already been proposed that the support plate not be connected with the pivotal lower mattress portion so that it can be upwardly pivoted. However, this in turn is associated with the disadvantage that the employed support plate no longer can be actuated by raising and lowering the adjustable lower mattress portion. This becomes even more problematic due to the fact that, as a general rule, there are required two support plates in order to obtain the requisite stability of the support. Hence, it is necessary to individually regulate both of the support plates when the lower mattress portion is raised. Moreover, the conventionally employed support plates which are intended for use with the head portions are not designed in such a manner that there can be realized satisfactory stability with a free articulated lever arm, so that additional means are required in order to guide the free lever ends such as to prevent lateral outward deflection. This again constricts the access opening to the bedding storage compartment or cabinet.

SUMMARY OF THE INVENTION

Hence, it is a primary object of the present invention to provide a new and improved construction of support or supporting plate arrangement of the aforementioned type which is not associated with the previously discussed limitations and shortcomings of the prior art proposals.

Another and more specific object of the present invention aims at the provision of a new and improved construction of a support plate arrangement which is suitable for "raisably supporting the foot end" of the furniture and allows the repose surface portion supported thereby to be sufficiently raised or elevated in order to comfortably have access to a bedding storage cabinet or the like.

Now in order to implement these and still further objects of the invention, which will become more readily apparent as the description proceeds, the support plate or support plate arrangement of this development serves for the adjustment of the inclination of at least one part or portion of the repose surface of a reclining piece of furniture, and is manifested by the features that there are provided two levers forming an articlated or hinged pair of levers, one of the levers is constituted by a substantially U-shaped rack member which is provided with teeth at the leg edges and can be secured to a part of the reclining furniture. A slide or slide member is displaceable upon the rack member. At the slide member there is guided the end of a support level member which is hingedly mounted at the second articulated lever, the aforementioned end of the support lever member engaging between the legs of the U-shaped rack member. Further, this end of the support lever member is guided such that it is movable in the slide member between a work position where it is in engagement with the teeth of the rack member and a rest position permitting the free displacement and rocking of the levers towards one another. According to significant aspects of the invention there is provided a spring or the like between both of the levers and/or a counterweight is provided at the second articulated lever which strives to spread apart the articulated levers from one another and the free end of the second articulated lever possesses a support or contact surface for the part of the repose surface which is adjustable in inclination.

The support plate or supporting plate arrangement of this invention, under the action of the aforementioned spring and/or the counterweight, can follow the repose or reclining surface which is to be supported by such support plate by means of the support or contact surface of the second articulated or hinged lever during the lifting of such repose surface until it has reached its terminal or end stop. Thus, within the normal pivotal range of an elevational foot rest support it is possible to adjust the desired height by raising the repose surface part or portion into desired position (and with subsequent release thereof). For instance, if in the morning it is desired to store away the bedding into the bedding storage cabinet, then, the relevant repose surface portion, if necessary while supporting the same with a conventional lifting aid can be raised to such a height by the action of the support plate or support plate arrangement that there is present a large access opening to the bedding storage cabinet. The second hinged lever arm is thus distanced by the action of the spring and/or the counterweight from the rack member an extent corresponding to the maximum possible spreading action. Such a terminal or end position, with a support plate of the previously mentioned type, conventionally corresponds to the reversal position from which location the support plate or supporting plate arrangement can be folded together without the support lever member engaging with the teeth of the rack member. Now if the raised repose or reclining support portion is lowered and if such is placed upon the contact surface of the second articulated or hinged lever, then, due to its inherent weight it tilts the second articulated lever towards the rack member into the starting position. The repose or reclining surface is then in a flat condition.

In order to be able to simply increase the stability of the support plate, it is advantageous to also construct the second articulated lever so as to possess a substantially U-shaped profie. The U-legs thereof thus should be spread apart from one another to such an extent that both the rack member as well as also the slide member located therat, in the folded together condition of the support plate, have sufficient space between such U-legs. In this way there is also realized such a large spacing of the legs that a web at the region of the free end of the second articulated lever can be constructed as a rounded support or contact surface of sufficient width, or, at the region of the aforementioned lever end, there can be mounted a roller of sufficient width between the previously mentioned legs.

If, in the case of less sturdy lower mattress frames, there is present the danger that when lifting the frame at one side it becomes distorted or twisted and hence there exist unequal elevational positions of the following lateral support plates, then by interconnecting the second articulated or hinged lever of both support plates by means of a torsion rod it is possible to realize the beneficial result that they must constrainingly follow one another at approximately the same elevation. In order to render this possible in a very simple manner, according to a further aspect of the invention, provision can be made that each second articulated lever carries a bearing for a torsion rod at the region of the articulated lever hinge. In order to be able to use a torsion rod at both sides at a support plate, according to a further facet of the invention it is possible to provide two holes in each leg of the second articulated lever into which there can be pressed locking pins or journals of a torsion rod bearing preferably formed of plastic. Thus, it is possible to use the support plate both with or without a torsion rod bearing. When necessary a bearing can be locked or engaged into position at the desired side.

With the conventional support plates the raising and lowering occurs manually, whereas in this case the upward movement occurs by the action of the spring and/or the counterweight. During use the teeth of the rack member could deform if the equipment is roughly handled, resulting in the presence of frictional forces at the slide member which no longer can be overcome by the spring and/or the counterweight.

In order to avoid the foregoing, a preferred exemplary embodiment of the invention contemplates providing at the gear rack lateral guide ribs for the slide member which is then guided in such a way that it does not contact the teeth of the gear rack.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
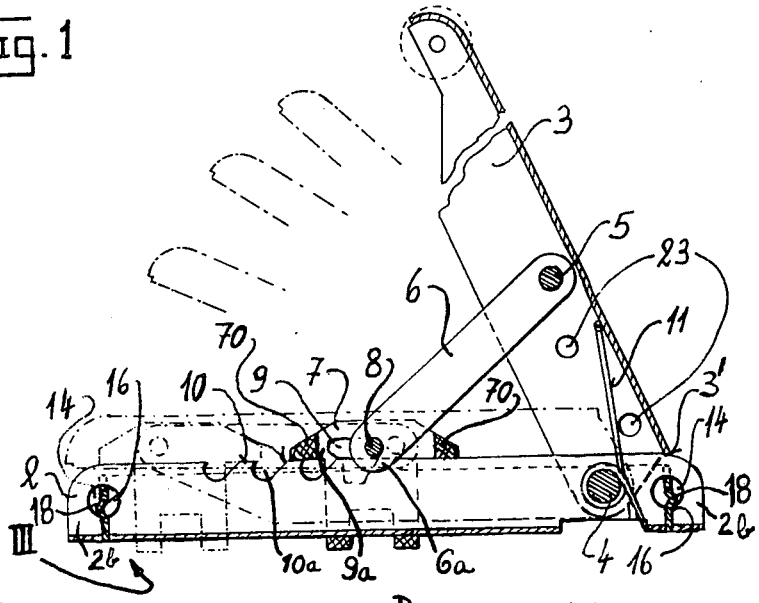
FIG. 1 is a longitudinal sectional view taken along the line I—I of FIG. 2 of a support plate or support plate arrangement designed according to the present invention and illustrated on a reduced scale.

Describing now the drawings, it is to be understood that the support plate or support plate arrangement 1 possesses a substantially U-shaped gear rack or toothed rack member 2 constituting a first hinged or articulated lever and a second hinged or articulated lever 3 which is hingedly connected by means of the axle bolts or pivot pins 4 into a hinged or articulated lever pair 2, 3. At the second articulated lever 3 there is pivotably mounted about a bolt or pivot pin 5 a support lever or support lever member 6 which engages with its lower end **6*a* between the spaced legs 2*a* of the substantially U-shaped rack member 2 and into the slide or slide member 7 which is mounted to be displaceable upon such gear rack 2. A bolt 8 of the support lever member 6 is guided in a slot-like window or opening 9 of the slide member 7 in a manner well known in this particular art. In the illustration shown in full lines in FIG. 1 the hinged or articulated levers 2 and 3 are located at the maximum spread or spaced apart position where a web 3' of the second articulated lever 3 impacts against the rack member 2. During the downward pivoting movement of the lever 3 the bolt or bolt member 8 shifts or displaces into the forwardmost portion of the window or opening 9 and at that location remains bearing against a projection 9*a* thereof, and it can slide over the teeth 10 of the rack member 2 until the lever 3 reaches the phantom-line illustrated folded together or collapsed position shown in FIG. 1. On the other hand, during the upward movement of lever 3, under the action of a spring 11 which tends to spread such lever 3 away from the rack member 2, the bolt member or bolt 8 drops into the gaps 10*a* between the teeth 10 and during a momentary or slight downward movement of the lever 3 the bolt 8 will engage with the teeth 10.** This type of locking or ratcheting action is completely standard.

Figure 5:
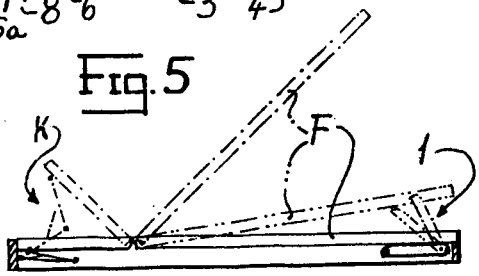
FIG. 5 is a markedly reduced longitudinal sectional view through a lower or supporting mattress provided with a head adjustment and a foot adjustment.

The lever 3 possesses at its free end **3*a* a rounded support or contact surface 12, as best seen by referring to FIG. 1, for the foot or lower end F (FIG. 5) of the repose or reclining surface of a lower mattress, —this foot end bearing upon the contact surface 12. However, instead of using a rounded sliding or guiding surface formed by the rounded contact surface 12 there also could be used a roller 13 or equivalent structure as shown in phantom lines in FIG. 1**.

Figure 2:
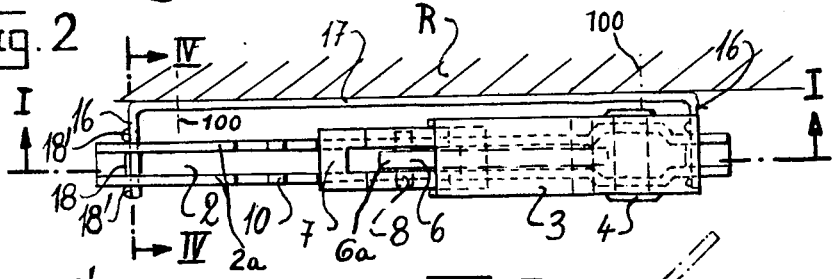
FIG. 2 is a top plan view of the support plate shown in FIG. 1.
Figure 3:
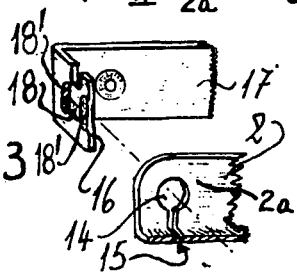
FIG. 3 is a perspective exploded view of the support plate end designated by the arrow III of FIG. 1.
Figure 4:
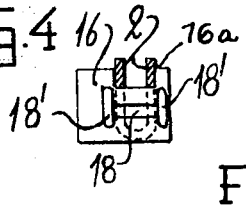
FIG. 4 is a cross-sectional view taken substantially along the line IV—IV of FIG. 2.

The toothed rack member 2 possesses two holes or bores 14 at its terminal regions 2*b*, each of which, as particularly well recognized by referring to FIG. 3, opens into a slot 15 at the underside of such rack member, so that legs or leg members 16 constructed as hooks of a substantially U-shaped attachment or securing bracket 17 secured by screws, schematically indicated by reference character 100, or equivalent structure at the lower mattress frame R, can be introduced from below through these slots 15, as particularly apparent by inspecting FIGS. 1, 2 and 4, and especially FIG. 1. The protruding or arched portion 18 of each leg or leg member 16 thus hooks into the associated hole or bore 14 (FIG. 1). By referring to FIG. 4 there will be recognized that the mouth 16*a* of a hook forming a leg 16 corresponds to the outer dimension of the rack member 2. Moreover, to both sides and below the hook mouth 16*a* there are provided further arched portions or protuberances 18' serving as lateral supports for the rack member 2. All of this structure insures for a positive supporting action and easier assembly or mounting.

Figure 6:
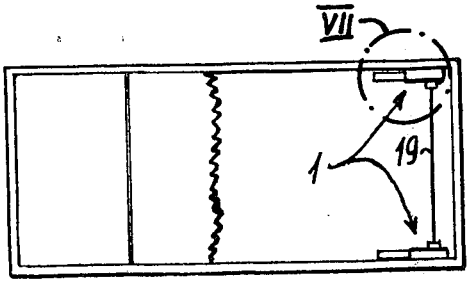
FIG. 6 is a partially broken plan view of the lower mattress shown in FIG. 5.
Figure 8:
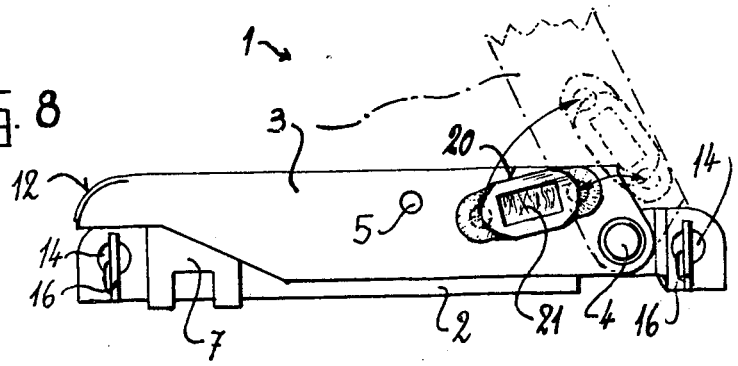
FIG. 8 is a side view looking in the direction of the arrow VIII of FIG. 7.
Figure 7:
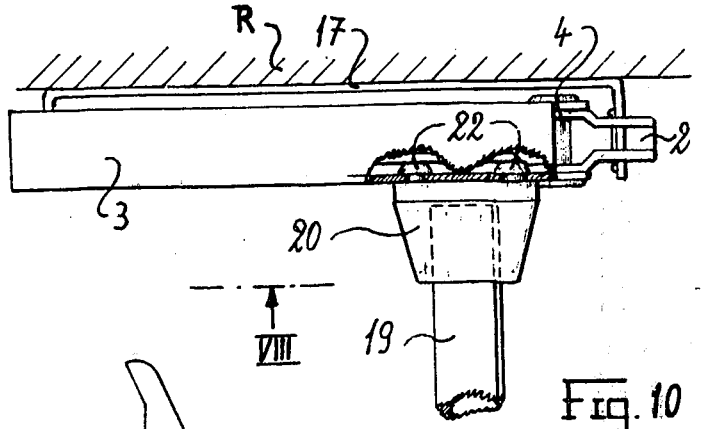
FIG. 7 illustrates the detail designated by the reference character VII in FIG. 6 approximately on a scale corresponding to that of the showing of FIGS. 1 to 4.

The connection of the toothed rack member 2 with the bracket member 17 however also has the advantage that it is possible to simultaneously mount a pair of support plates 1 which are interconnected by a torsion bar or rod 19, as shown in FIG. 6. The torsion bar or rod 19 with its respective end bearing 20, one of which is visible in FIGS. 7 and 8 then can be mounted at the associated lever 3 by means of a simple plug connection. In order to hold the torsion bar or rod 19 rigidly against rotation in its bearing 20, this bearing 20 is provided with a non-circular opening 21 which is appropriately dimensioned and configured with respect to the external dimension of the torsion bar 19. The bearing 20 is provided at its surface confronting the lever or lever member 3 with two substantially mushroom-shaped locking or engaging pins 22 which can be inserted through the holes or bores 23 of a leg of the lever 3, these bores 23 being clearly visible in FIG. 1. The torsion bar 19 should be located as closely as possible to the pivot axle or shaft 4. In this way there is realized the advantage that with the arrangement illustrated in FIGS. 5 and 6 there is practically no impairment of the accessibility to a bedding storage cabinet or the like. The fact that the frame portion F, as indicated in phantom lines in FIG. 5, can be raised because it is not secured to the lever or lever member 3 is likewise required to provide good accessibility to the bedding storage cabinet. The conditions which prevail in the case of a conventional support plate mounted at a pivotable and at a stationary portion of the lower mattress have been illustrated in FIG. 5 by reference character K, and it is to be noted that the support plate itself requires a certain amount of space and the extremely small opening practically renders impossible access to the bedding storage cabinet.

Figure 9:
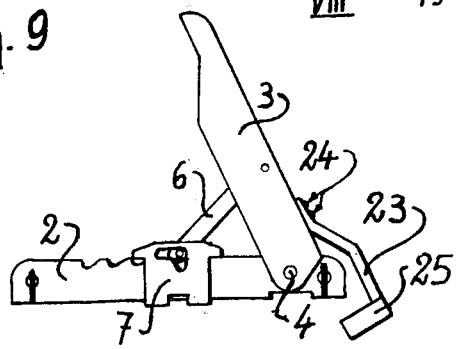
FIG. 9 is a schematic side view, similar to FIG. 1, but on a reduced scale and in a more simplified illustration of another embodiment of support plate or supporting plate arrangement of the invention.

Under certain circumstances it can be of advantage, instead of providing the spring 11 (FIG. 1) or equivalent structure, or in addition to the provision of such spring, to provide a counterweight 25 at the second hinged or articulated lever 3, as the same has been shown in FIG. 9. Even though it is possible to mount in any other random chosen manner a counterweight, nonetheless the exemplary embodiment shown in FIG. 9 is of advantage because it permits the subsequent application of a counterweight 25 by means of rivets or screws 24 or by welding or other suitable attachment techniques or expedients, and the articulated lever 3 can be extended past the point of rotation or pivoting (bolt 4) by means of the counterweight lever arm 23, at the end of which there is located the counterweight 25, as shown.

Figure 10:
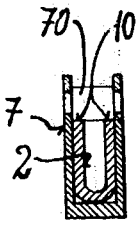
FIG. 10 is an enlarged cross-sectional view through a slide or slide member arranged at a gear rack according to the arrangement of FIG. 1.
Figure 11:
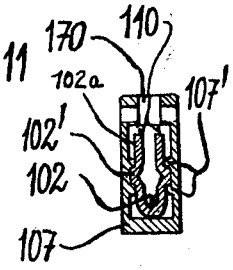
FIG. 11 is a cross-sectional view, similar to the showing of FIG. 10, through a preferred exemplary embodiment of the slide or slide member.

While with conventional support plates raising and lowering occurs manually, with the support or supporting plate according to the invention, and although the pressing down thereof occurs manually, the upward movement of the second articulated lever 3 is however brought about by the action of the spring 11 and/or the counterweight 25. Now if, as shown in FIGS. 1 and 10, there is provided a slide member 7 which to a certain extent bears completely circumferentially about and relatively closely to the surfaces of the toothed rack member 2, and if such slide member slides at the rack teeth 10 by means of sliding or gliding elements 70, then it is possible for the system to become blocked if the teeth are hit hard when not carefully operating the system. Lateral deformation of the teeth can bring about the undesirable result that the teeth tend to claw into the slide member 7 in such a way that they impair its mobility to such an extent that the spring and/or the counterweight is no longer able to upwardly move the second hinged or articulated lever. In order to prevent this undesirable result and to otherwise eliminate the need of unnecessarily strong springs and/or unnecessarily large counterweights, a preferred exemplary embodiment of the invention contemplates coordinating the rack member and the slide member to one another in such a way that the slide member does not touch the teeth of the rack member. An example of such embodiment of the invention has been illustrated in FIG. 11. The toothed rack member 102 which, in sectional view, possesses a substantially U-shaped configuration is provided at each leg 102*a* with an outwardly stamped or protruding rib member 102' at which bear guide cams or dogs 107' of the slide member 107. The upper connection piece or element 170 of the slide member 107 therefore does not bear against the gear rack teeth 110. There is also present a lateral spacing of the slide member from these teeth 110. Even if the teeth 110 are briskly impacted they cannot undesirably engage with the slide member 107. The spatial requirements of the stamped guide ribs or rib members 102' can be compensated owing to their stabilizing action in terms of a narrower construction of the rack member 102. Hence, there is not even necessary an increased amount of space.

While there is shown and described present preferred embodiments of the invention, it is to be distinctly understood that the invention is not limited thereto, but may be otherwise variously embodied and practiced with the scope of the following claims. Accordingly,

What is claimed is:

1. A support plate arrangement for adjusting the inclination of at least one part of a repose surface of reclining furniture, comprising two levers, means for hingedly interconnecting said two levers to form a pair of hinged levers, one of the levers being constituted by a rack member secured to the reclining furniture said rack member having teeth and possessing a substantially U-shaped profile including leg members having leg edges provided with teeth, a slide member displaceable upon the rack member in the lengthwise direction of the rack member during adjustment of the reclining furniture, a support lever member, means for hingedly connecting the support lever member at the other lever defining a second hinged lever, means for permitting an end of the support lever member to be guided between the leg members of the rack member such that the support lever member is movable in the slide member between a work position where it is in engagement with the teeth of the rack member and a rest position which permits the free displacement and pivoting of the levers towards one another into a collapsed position, means provided for spreading the hinged levers from one another, said second hinged lever having a free end possessing a contact surface for the part of the repose surface which is adjustable in inclination.

2. The support plate arrangement as defined in claim 1, wherein said spreading means comprises a spring arranged between both hinged levers.

3. The support plate arrangement as defined in claim 1, wherein the second hinged lever possesses a substantially U-shaped configuration having a pair of legs affording space therebetween for accommodating the rack member and the slide member.

4. The support plate arrangement as defined in claim 3, wherein with maximum spreading of the hinged levers a web of the second hinged lever impacts against the rack member.

5. The support plate arrangement as defined in claim 1, wherein said contact surface comprises a domed slide surface.

6. The support plate arrangement as defined in claim 1, wherein said contact surface is constituted by a roller which is rotatably mounted at the second hinged lever and against which bears the repose surface of the reclining furniture.

7. The support plate arrangement as defined in claim 1, wherein the rack member has ends at the region of which there is provided a respective hole for the attachment of the rack member at the furniture.

8. The support plate arrangement as defined in claim 7, wherein for the attachment of the rack member at the furniture there is provided a bracket which can be secured to the furniture, said bracket having projection means which can be arrested in the holes of the rack member ends.

9. The support plate arrangement as defined in claim 7, wherein each of said attachment holes opens into a slot at the underside of the rack member.

10. A support plate arrangement for adjusting the inclination of at least one part of a repose surface of reclining furniture, comprising two levers, means for hingedly interconnecting said two levers to form a pair of hinged levers, one of the levers being constituted by a rack member secured to the reclining furniture, said rack member having teeth and possessing a substantially U-shaped profile including leg members having leg edges provided with teeth, a slide member displaceable upon the rack member, a support lever member, means for hingedly connecting the support lever member at the other lever defining a second hinged lever, means for permitting an end of the support lever member to be guided between the leg members of the rack member such that the support lever member is movable in the slide member between a work position where it is in engagement with the teeth of the rack member and a rest position which permits the free displacement and pivoting of the levers towards one another, means provided for spreading the hinged levers from one another, said second hinged lever having a free end possessing a contact surface for the part of the repose surface which is adjustable in inclination, the rack member having ends at the region of which there is provided a respective hole for the attachment of the rack member at the furniture, each of said attachment holes opening into a slot at the underside of the rack member, wherein for the attachment of the rack member at the furniture there is provided a substantially U-shaped bracket member which can be secured to the furniture, said U-shaped bracket member having legs constructed as hooks and with the exception of a projection of each leg for engagement in one of said attachment holes the rack member possesses a thickness which substantially corresponds to the thickness of each slot of the attachment holes of the rack member, each leg having a hook mouth the width of which is approximately the same size as the outer spacing of the legs of the rack member from one another.

11. The support plate arrangement as defined in claim 10, further including additional projections as side supports of the rack member at each leg to both sides and below the hook mouth.

12. A support plate arrangement for adjusting the inclination of at least one part of a repose surface of reclining furniture, comprising two levers, means for hingedly interconnecting said two levers to form a pair of hinged levers, one of the levers being constituted by a rack member secured to the reclining furniture, said rack member having teeth and possessing a substantially U-shaped profile including leg members having leg edges provided with teeth, a slide member displaceable upon the rack member, a support lever member, means for hingedly connecting the support lever member at the other lever defining a second hinged lever, means for permitting an end of the support lever member to be guided between the leg members of the rack member such that the support lever member is movable in the slide member between a work position where it is in engagement with the teeth of the rack member and a rest position which permits the free displacement and pivoting of the levers towards one another, means provided for spreading the hinged levers from one another, said second hinged lever having a free end possessing a contact surface for the part of the respose surface which is adjustable in inclination, bearing means provided at the second hinged lever for the reception of a torsion bar, a torsion bar mounted at said bearing means and secured against rotation thereat, said bearing means serving for the connection of the support plate arrangement with a second support plate arrangement.

13. The support plate arrangement as defined in claim 12, wherein the torsion bar-bearing means comprises a body member possessing an opening configured for the reception of an end of the torsion bar to secure the same against rotation, at least one pin provided at the body member, said pin engaging in a hole of the second hinged lever for securing said body member against rotation.

14. The support plate arrangement as defined in claim 13, wherein said at least one pin engaging through a hole of the second hinged lever is constructed as a locking member.

15. The support plate arrangement as defined in claim 12, wherein the torsion bar-bearing means is arranged near to said hingedly interconnecting means for the two levers.

16. The support plate arrangement as defined in claim 1, wherein the rack member is provided with lateral guide ribs for the slide member to prevent contact thereof with the teeth of the rack member.

17. The support plate arrangement as defined in claim 1, wherein said spreading means comprises a spring arranged between both of the hinged levers and a counterweight provided at the second hinged lever.

18. The support plate arrangement as defined in claim 1, wherein said spreading means comprises a counterweight provided at the second hinged lever.

19. The support plate arrangement as defined in claim 18, wherein the second hinged lever possesses a substantially U-shaped configuration having a pair of legs affording space therebetween for accommodating the rack member and the slide member.

20. The support plate arrangement as defined in claim 19, wherein with maximum spreading of the hinged levers a web of the second hinged lever impacts against the rack member.

21. The support plate arrangement as defined in claim 18, wherein said spreading means further comprises a spring arranged between both of the hinged levers.

* * * * *